US006014830A

United States Patent [19]

Brown et al.

[11] Patent Number: 6,014,830

[45] Date of Patent: Jan. 18, 2000

[54] REMOUNTABLE GUN SIGHT FOR LOW ILLUMINATION

[76] Inventors: Gary R. Brown, P. O. Box 216; Michael P. Toepel, P.O. Box 343, both of Pittsfield, N.H. 03263

[21] Appl. No.: 09/047,538

[22] Filed: Mar. 25, 1998

Related U.S. Application Data

[63] Continuation-in-part of application No. 08/845,066, Apr. 21, 1997, Pat. No. 5,862,618.

[51] Int. Cl.[7] ..... F41C 3/14; F41G 21/00; F41G 1/00

[52] U.S. Cl. ..... 42/100; 33/233; 33/241; 33/242

[58] Field of Search ..... 42/100, 101, 102, 42/103; 33/241, 242, 243, 233; 362/110

[56] References Cited

U.S. PATENT DOCUMENTS

| | | | |
|---|---|---|---|
| D. 253,545 | 11/1979 | Chesnut | 33/233 |
| D. 393,306 | 4/1998 | Couper | 33/241 |
| 1,292,211 | 1/1919 | Young et al. | 33/241 |
| 2,123,273 | 7/1938 | Burton | 33/233 |
| 2,239,231 | 4/1941 | Hooks | 33/233 |
| 2,295,791 | 9/1942 | Hornback | 33/241 |
| 2,610,405 | 9/1952 | Dickinson | 42/100 |
| 2,628,426 | 2/1953 | West | 33/242 |
| 2,645,017 | 7/1953 | Haase | 42/100 |
| 2,795,048 | 6/1957 | Seymour et al. | 42/100 |
| 2,799,936 | 7/1957 | Luebkeman | 33/242 |
| 2,855,680 | 10/1958 | Christensen | 42/100 |
| 2,969,594 | 1/1961 | Palmer . | |
| 3,098,303 | 7/1963 | Plisk . | |
| 3,187,436 | 6/1965 | Freidrichmeier . | |
| 3,555,687 | 1/1971 | Joseph | 42/101 |
| 3,641,676 | 2/1972 | Knudson et al. . | |
| 3,820,248 | 6/1974 | Hayward . | |
| 3,840,995 | 10/1974 | Freiling | 33/242 |
| 4,455,776 | 6/1984 | Ashley et al. | 42/101 |
| 4,458,463 | 7/1984 | Bohl . | |
| 4,574,335 | 3/1986 | Frimer . | |
| 4,894,941 | 1/1990 | Karrow, Jr. | 42/103 |
| 5,065,519 | 11/1991 | Bindon . | |
| 5,121,462 | 6/1992 | Fabre et al. . | |
| 5,359,800 | 11/1994 | Fisher et al. . | |
| 5,373,657 | 12/1994 | Betz et al. . | |
| 5,442,861 | 8/1995 | Lorocco . | |
| 5,471,777 | 12/1995 | McDonald . | |
| 5,638,604 | 6/1997 | Lorocco . | |

FOREIGN PATENT DOCUMENTS

| | | |
|---|---|---|
| 470-016-A | 2/1992 | European Pat. Off. . |
| 2154332 | 9/1985 | United Kingdom . |

OTHER PUBLICATIONS

Optectron—Fluorescent Plastic Optical Fiber(gen. description, 2 pages), Sep. 1991.

*Primary Examiner*—Charles T. Jordan
*Assistant Examiner*—Theresa M. Wesson
*Attorney, Agent, or Firm*—Stephe G. Matzuk

[57] ABSTRACT

A removable and remountable gun sight comprising a point light viewable through an elongated tubular structure having a anti-reflective coating along the inner surface thereof, and a captive removable low illumination light source, preferably a chemical illuminating capsule, disposed to provide the point light source with illumination in low ambient or darkness. The gun sight is retained by a substantially C-shaped clip which engages the gun barrel, ventilation rib or other available gun portion along a length which requires the shooter to elevate one end apart from the gun portion to effect removal from the gun. Alternate embodiments include ambient light energized luminous rod elements interposed between the captive light source and the distal end of the elongated tubular structure, which provides continuous illumination of the point source to the shooter as he moves from high ambient light to low ambience or darkness.

15 Claims, 4 Drawing Sheets

REMOUNTABLE GUN SIGHT FOR LOW ILLUMINATION

This application is a Continuation-In-Part of U.S. patent application Ser. No. 08/845,066, filed Apr. 21, 1997, now U.S. Pat. No. 5,862,618, of the applicant.

FIELD OF THE INVENTION

The present invention relates to gun sights, in particular, to removable gun sights operable in low illumination settings.

BACKGROUND OF THE INVENTION

The accuracy of target shooting and other instances of gun shooting is often related to the applicability, in the shooting environment, of the particular gun sight used. Often target and background illumination intensity vary greatly, making one style of gun sight become less useful, non-functional or even distracting as the lighting conditions change. It is therefore important that the shooter not only have a gun sight that is functional in moderate conditions and minimizes or eliminates related aiming and shooting problems such as cross-eye dominance, etc., but also function in both high or low illumination conditions and smoothly transition its operation as conditions change so as not to distract the shooter from the target or his style of target sighting.

Other changes of conditions or shooter gun sight preferences require that the gun sight, in addition to providing repeatable accuracy, be durable, removable and remountable without significant difficulty and be adaptable to gun type and dimensional variations. Previous gun sights often require permanent or semi-permanent mounting which requires special tooling or working to remove and accurately remount and align. In view of the many restrictions encountered with previously known gun sights, the marginal advantages by many gun sights are simply not worth the bother, requiring the shooter accommodate to the changes as best he can without changing the sight or having the sight respond to the changing conditions.

SUMMARY OF THE INVENTION

The present invention comprises a removable and easily remountable gun sight having a compliant elongated U- or C-shaped retaining member which provides a firm grip to the gun barrel, ventilation rib, or other available gun member, and readily conforms to any variations the gun member, providing a firm and repeatable attachment thereto. The shaped retaining member facilitates removal by simply raising away one end with a digit from the gun and continuing to withdraw the gun sight until it is entirely detached from the gun.

The gun sight of the present invention also includes an elongated tubular member having anti-reflective coating therein and a luminous rod received at an end distal from the shooter. The luminous rod typically is energized by ambient light and thus provide a sighting spot generally proportional to the ambient light of the target shooting area. The present invention also provides smooth transition to areas of low illumination by a self-luminous source, typically a chemical light, mounted at the forward or distal end of the luminous rod and providing light energization to the rod. Further improvements include a light cover or enclosure to eliminate visible light which may cause confusion from the non-shooting eye and invite return fire in security applications.

BRIEF DESCRIPTION OF THE DRAWING

These and further features of the present invention will be better understood by reading the following Detailed Description together with the Drawing, wherein.

DETAILED DESCRIPTION OF THE INVENTION

Figure 1:
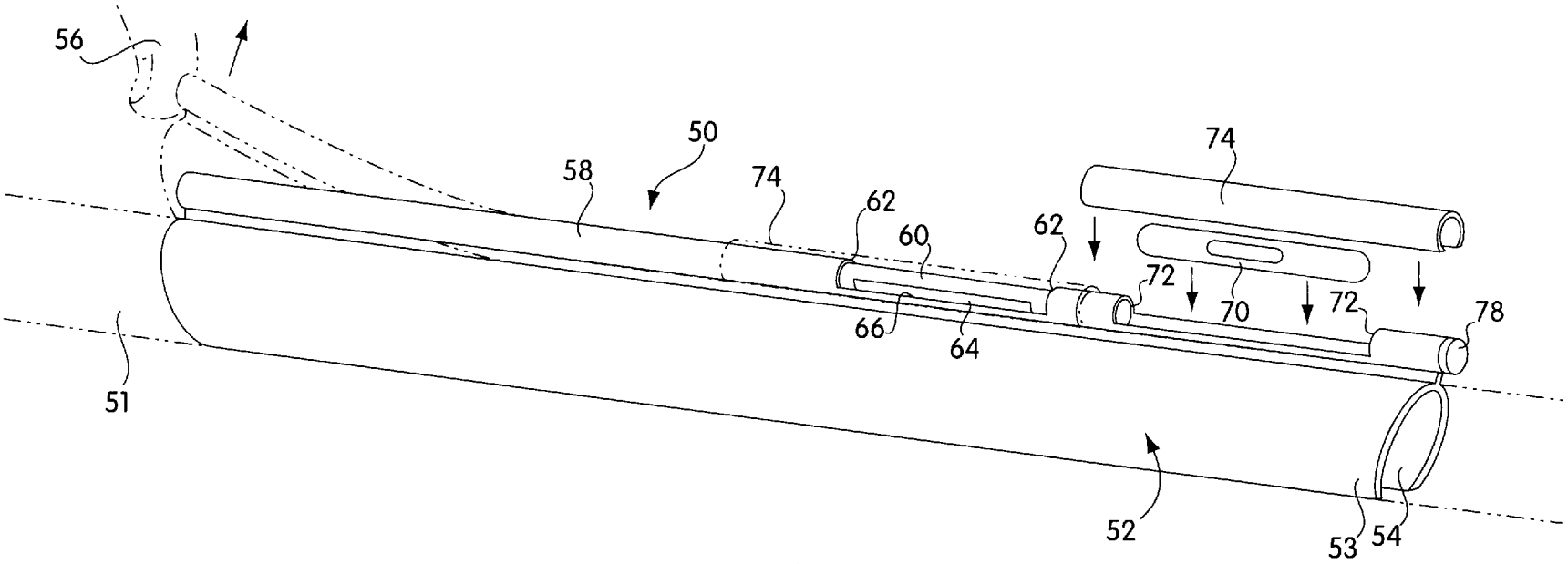
FIG. 1 is a perspective view of one embodiment according to the present invention with partial exploded view.

The present invention incorporates by reference the structure provided in U.S. patent application Ser. No. 08/845,066, filed Apr. 21, 1997, pending of the applicant The preferred embodiment 50 according to the present invention is shown in FIG. 1 comprising an extruded plastic structure having a generally U- or C-shaped lower clip portion 52 which substantially surround the gun barrel 51 (shown in phantom) and apply a compression force thereon. Typically, the arcuate clip portion or segments will circumferenially surround the gun barrel by more than 180 degrees. Alternately, if the clip has generally parallel opposing clip arms 53 and 54 (as in the embodiment 100 of FIG. 3), the clip need only surround 180 degrees of the gun member. When mounted over the gun barrel 52, the gun sight 50 may be removed by uplifting one end with a digit 56 causing the entire gun sight to flex beginning at the uplifted end, wherein the clip arm release the gun barrel beginning at the uplifted end, and moving the point of release toward the other end of the gun sight 50 as it is pulled away from the barrel 52. It is preferred to terminate the forward and rearward ends of the gun sight in tapered or slanted (oblique or non-normal to the gun axis or longest dimension of the gun sight) cuts which facilitate their removal when pulled away from the gun barrel or gun member.

Running longitudinally along and attached to the clip 52 is the sighting tube 58 having an aperture therein, preferably but not necessarily circular, extending for a length of 2"–5" with an 4 mm. aperture. A luminous fiber rod 60, such as green BCF93 manufactured by Bicron/Saint Gobain Industrial Ceramics, Inc., of Newbury, Ohio, is energized by ambient illumination and is received into a first recess 62 formed within the sighting tube 58 and generally retained by the sighting tube 58 at the ends of the rod 60 being substantially the same diameter as the recess. The fiber rod has one of a different intensity and color when viewed obliquely or axially. A larger or smaller rod and aperture diameter may be used with a proportional change in aperture length. A light reflector 64 is disposed between the rod 60 and the unremoved portion of the gun sight, and may be adhesively mounted to either the rod 62 or the unremoved portion 66 of the gun sight.

Embodiments according to the present invention include an aperture length (through which the rod is viewable)-to-viewable rod end diameter ratio of at least 30 to provide the shooter desired accuracy, although versions according to the present invention modified for quick target acquisition may also include a ratio of 12 or greater A second recess 72 is formed in the sighting tube 58 forward of the first recess 62 to receive a self-luminous photochemical light source, such as the green mini-type A Cyalume Light Stick, manufactured by Omniglow Corp., or equivalent light source. The light source 70 is retained within the second recess with an elongated light-opaque cover 74 which extends beyond the length of the second recess 72 to form a substantially light restrictive container to restrict the light from the light source 70 from escaping through the second recess 72. Typically, the cover 74 comprises a resilient plastic having a substantially complete annular cross-section, excepting a portion which contacts the connecting portion of the gun sight (clip to sighting tube connecting portion) would allow the cover 74 to slide along the sighting tube 58. Minimally, the cover serves to retain the light source within the second recess and to block observers forward of the gun sight (opposite shooter or the elongated member) from seeing the illumination provided by the light source 70; such functions may be individually provided by separate structure in alternate embodiments (not shown). The cover 74 has an aperture therein to closely fit over the portions of the sighting tube adjacent to the second recess 72 when disposed thereon. The cover 74 may also slide rearward (shown in phantom) to reveal the second recess and allow installation or release of the light source 70. An opaque plastic plug 78 is also provided which prevents the light source 70 from being observed forward of the gun sight 50.

Thus, the light source is observable only through the luminous fiber rod 60 and provides energization thereof, the result being a constantly viewable point light source as the ambient light is varied from brightness to darkness. Typically the light viewable to the shooter through the aperture will remain appropriate to maintain an undistracted aim while the ambient light changes, especially as the light from the source 70 begins to predominate.

Also according to the present invention, the color of the rod 60 and the light source 70 is selectable to provide a gun sight appropriate for the conditions encountered by the shooter or according to his preference. The present invention is easily removable and remountable and provides consistent alignment of rapidly interchangeable sights with which the shooter can use to adapt the gun to varying conditions.

Figure 2A:
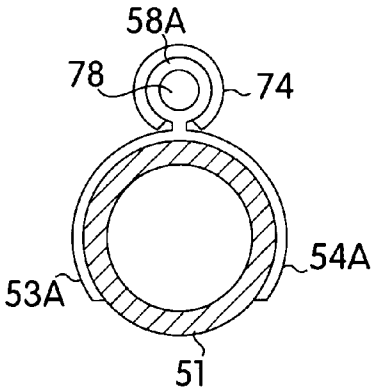
FIG. 2A is the end view of the embodiment of FIGS. 1 and 2 mounted on a gun barrel.
Figure 2:
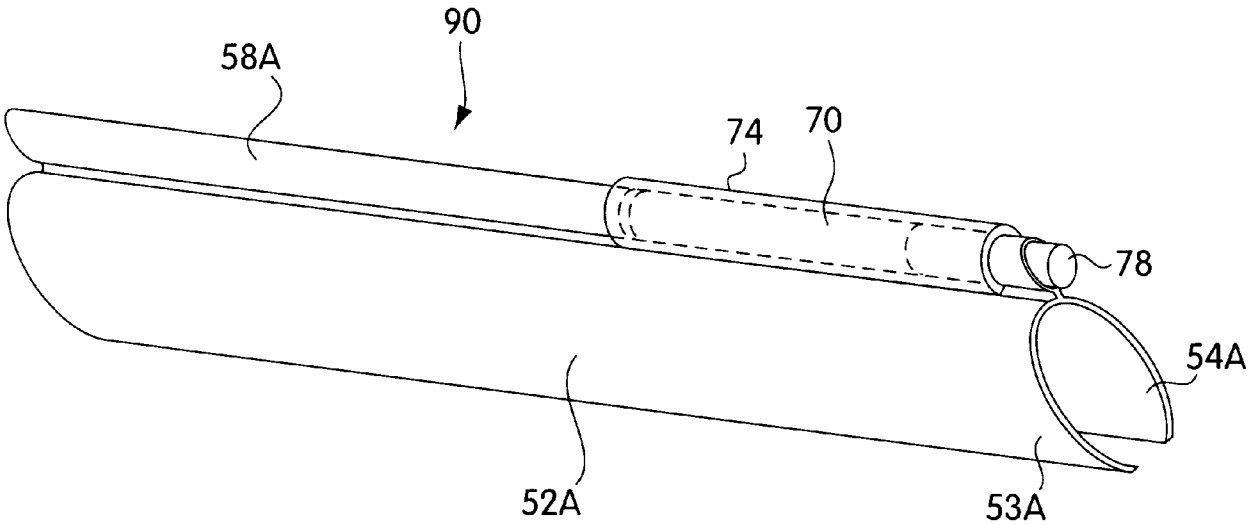
FIG. 2 is a perspective view of an alternate embodiment according to the present invention.

A further embodiment 90 is shown in FIG. 2, wherein the rod 60, first recess 62, reflector 64 is omitted, providing an illuminated night gun sight which also provides sufficient point illumination to function as a day light gun sight. The point of light is the illuminated end of the light source 70 viewable through an aperture in the sighting tube 58A having a non-reflective coating on the inner surface thereof. In very bright illumination, the profile of the sighting tube 58A and cover 74 is used as the sight. The embodiment 90 of FIG. 2 also shows an oblique forward gun sight cut-off parallel to the rearward cut-off, having forward extending clip arms 53A and 54A.

An end view of the embodiments 50 and 90 from the forward end of the sight (as mounted on the gun barrel 52) is shown in FIG. 2A, where it can be seen that the clip arms extend more than 180 degree around the barrel 180. Parallel clip arms are within the scope of the present invention, but are preferred when mounting to gun members having parallel surfaces, such as with regard to the embodiment of FIG. 3, 3A and 3B.

Figure 3:
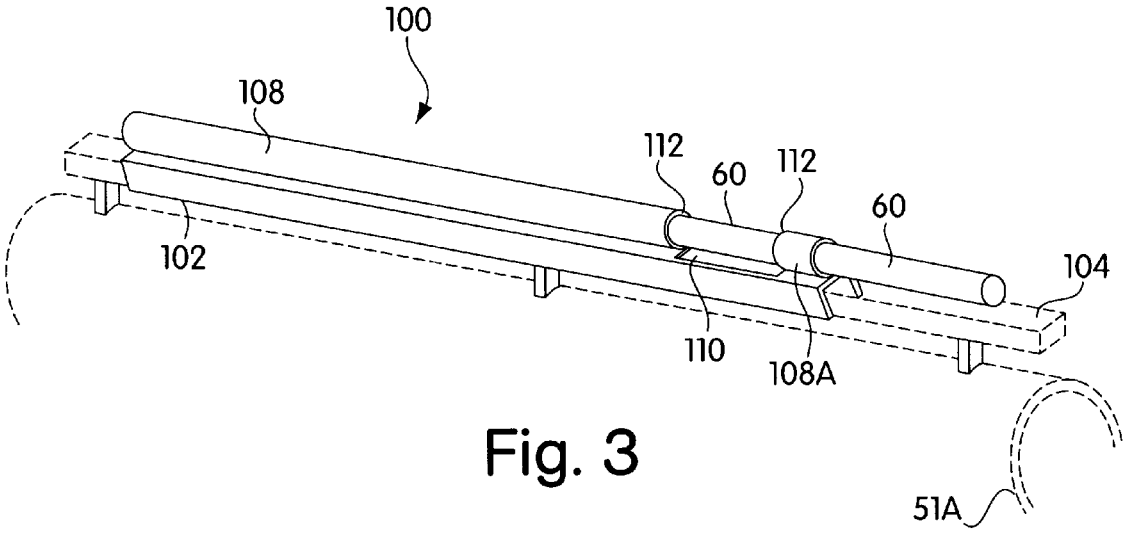
FIG. 3 is a perspective view of a further alternate embodiment according to the present invention.
Figure 3A:
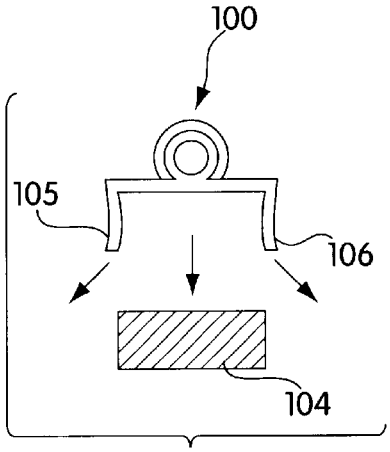
FIG. 3A is the end view of the embodiment of FIG. 3 prior to retention by gun member.
Figure 3B:
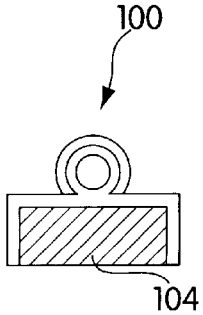
FIG. 3B. is the end view of the embodiment of FIG. 3 being retained by gun member.

A further embodiment 100 is shown in FIG. 3 which is mountable to the generally flat ventilating rib 104 often provided as part of certain guns extending along and mounted to the gun barrel thereof. The light source low light illumination implementation of the prior inventive embodiments are not illustrated in this embodiment but is within the scope of the present invention to be included. The clip portion 102 has a somewhat squared-off cross section, the ends of the generally planar, confronting clip arms 105 and 106 being closer slightly together when unmounted to facilitate secure gripping of the rib 104 as shown in FIGS. 3A and 3B. The sighting tube 108 has an aperture therein and extends along and is mounted to the clip 102, and has a non-reflective coating thereon. A luminous plastic rod 60A is provided and received into the forward end of the sighting tube 108 and in a recess 112, and as in the other embodiment, the end thereof proximal to the shooter is viewable as the point of light used in gun aiming. A light reflector 110 is mounted between the rod 60A and the remaining portion of the gun sight to provide enhanced ambient light energization of the rod 60A. The forward end of the rod 60 is retained by a portion 108A of the sighting tube, and the rod 60A extends forward of the clip 102 and arms 105, 106 for enhanced ambient light energization. The gun sight includes non-normal, oblique end cuts to facilitate mounting and removal as described above with respect to the above embodiments.

Figure 4:
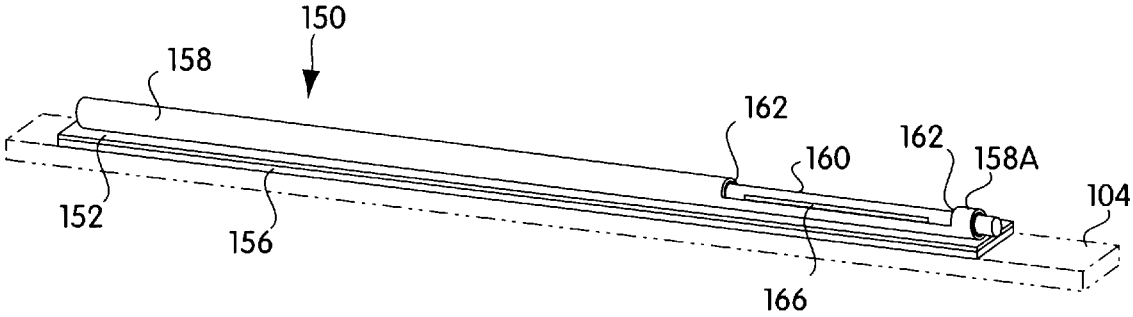
FIG. 4 is a perspective view of a further alternate embodiment according to the present invention.
Figure 4A:
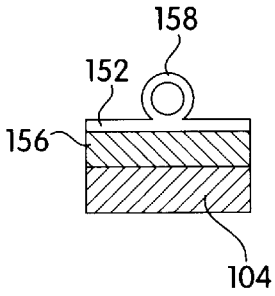
FIG. 4A is the end view of the embodiment of FIG. 4 adhesively retained by gun member.

A further embodiment 150 is shown in FIG. 4 comprises adhesive mounting material 156 (or equivalent) disposed between a longitudinally disposed plastic strip 152 and the rib 104 of the gun. Attached to the strip 152 is a sighting tube 158 having an aperture therein (including a non-reflective coating thereon) and receiving a luminous rod 160 at the forward end thereof in a recess 162. A reflector strip 166 is provided between the rod 160 and the remaining portion of the gun sight for enhanced light gathering and energization of the rod 160. The rod 160 is retained at the forward end by a portion 158A of the sighting tube. This embodiment may also include a 2 mm diameter aperture (and correspondingly sized rod 160) with an approximate length of aperture through which the rod is viewed by the shooter of 3⅛", although a diameter-to-aperture length of 40 is envisioned according to the present invention for shotguns and rifles, and 12 for handguns.

Typically, the non-reflective coating on the inner surface of the sighting tube aperture by applying a sticky film (e.g. with a thin paint) to the surface and pass a non-reflective powder (e.g. blue or black chalk) therethrough, wherein the powder will evenly and substantially completely coat the surface, providing the desired non-reflective surface. Other coatings, structure and methods are within the scope of the present invention for providing aperture surface non-reflection from the viewable end of the rod to the shooter.

Manufacture according to the present invention other than by plastic extrusion is within the scope of the invention. Moreover, the selection of luminous plastic, light source and other elements is not restricted to the exemplary items described herein and may comprise elements known to those of ordinary skill in the art. For instance, an embodiment of the present invention may also comprises a tubular member, planar strip or linear member, and/or securing means formed as a unitary and/or extruded plastic member. Further modifications and substitutions are within the scope of the present invention which is not to be limited, except by the claims which follow.

What is claimed is:

1. A gun sight mountable to a gun capable of firing a projectile along an axis, comprising:

an elongated tubular member having a proximal and a distal end and including an aperture therein and being aligned parallel to said axis and having means for reducing internal light reflections disposed thereon;

a luminous rod having a proximal and a distal end, said proximal end being received by said distal end of said elongated tubular member, wherein said luminous rod has one of a different intensity and color when viewed obliquely or axially;

a planar strip having a proximal and a distal end and a length substantially corresponding to the length of said elongated tubular member and said luminous rod received by said elongated tubular member and being attached to said elongated tubular member;

securing means attached to said distal end of said planar strip and disposed to secure said distal end of said luminous rod; and a reflective strip disposed between said luminous rod and said planar strip.

2. The gun sight of claim 1, wherein said luminous rod has a cross-section corresponding to the cross-section of said aperture.

3. The gun sight of claim 1, wherein said securing means comprises an adhesive strip.

4. The gun sight of claim 1, wherein said securing means comprises an annular member having an inner aperture corresponding to the aperture of said elongated tubular member and receiving said luminous rod therein.

5. The gun sight of claim 1, wherein said elongated tubular member, planar strip, and securing means is formed from a unitary extruded plastic member.

6. A gun sight to be attached to a gun capable of firing a projectile along an axis, comprising:

an elongated tubular member having a proximal and a distal end and including aperture therein and therealong and being aligned parallel to said axis and having means for reducing internal light reflections disposed thereon;

a receiver of a self-luminous member disposed at the distal end of said elongated tubular member for providing a light source into the distal end of said elongated tubular member in the absence of ambient light; and a linear member having a proximal and a distal end and a length substantially corresponding to the length of said elongated tubular member and said receiver, and being attached to said elongated tubular member and including a resilient clip element for attaching said gun sight to said gun.

7. The gun sight of claim 6, further including a light cover for occluding light emissions in the direction away from the proximal end.

8. The gun sight of claim 7, wherein said light cover comprises a removable, slidable cover.

9. The gun sight of claim 8, wherein said light cover is substantially completely covering said self-luminous member.

10. The gun sight of claim 6 further including a luminous rod having a proximal and a distal end, and being received by a recess within said elongated tubular member at the distal end of said elongated tubular member between said elongated tubular member and said self-luminous member, wherein said luminous rod has at least one of a different intensity and color when viewed obliquely or axially.

11. The gun sight of claim 6, further including securing means attached to said distal end of said linear member and disposed to secure said distal end of said self-luminous member; and a reflective strip disposed between said self-luminous member and said linear member.

12. The gun sight of claim 6, wherein said resilient clip element comprises substantially planar confronting arms extending from said linear member to surround at least a portion of a gun member extending in the direction of the gun barrel.

13. The gun sight of claim 6, wherein said resilient clip element comprises substantially arcuate confronting arms extending from said linear member to form an annular member segment to surround more than 180 degrees of a cylindrical portion of a gun member extending in the direction of the gun barrel.

14. The gun sight of claim 6, wherein said resilient clip comprises ends non-normal to the longest dimension of said clip.

15. The gun sight of claim 6, wherein said elongated tubular member and said linear member comprises an extruded plastic member.

* * * * *